US007175296B2

(12) United States Patent
Cok

(10) Patent No.: US 7,175,296 B2
(45) Date of Patent: Feb. 13, 2007

(54) REMOVABLE FLAT-PANEL LAMP AND FIXTURE

(75) Inventor: Ronald S. Cok, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/158,146

(22) Filed: Jun. 21, 2005

(65) Prior Publication Data

US 2006/0285364 A1 Dec. 21, 2006

(51) Int. Cl.
*F21S 8/00* (2006.01)

(52) U.S. Cl. ..... 362/147; 362/652

(58) Field of Classification Search ..... 362/84, 362/147, 647, 652, 287, 427
See application file for complete search history.

(56) References Cited

U.S. PATENT DOCUMENTS 3,504,172 A 3/1970 Libeman
4,769,292 A 9/1988 Tang et al.
5,061,569 A 10/1991 VanSlyke et al.
6,565,231 B1 * 5/2003 Cok ..... 362/653
6,819,036 B2 11/2004 Cok
2002/0136001 A1 9/2002 Lefkovitz et al.
2003/0198008 A1 * 10/2003 Leapman et al. ..... 361/681
2003/0222558 A1 * 12/2003 Cok ..... 313/238
2003/0222559 A1 * 12/2003 Cok ..... 313/238
2005/0190569 A1 * 9/2005 Peng ..... 362/490

* cited by examiner

*Primary Examiner*—Renee Luebke
*Assistant Examiner*—Julie A. Shallenberger
(74) *Attorney, Agent, or Firm*—Thomas J. Strouse

(57) ABSTRACT

A flat-panel lamp and fixture having a removable flat-panel lamp having at least two externally accessible electrode contacts and a fixture for removably receiving the flat-panel lamp and providing electrical connections to the at least two externally accessible electrode contacts. At least one rotating element that rotates to hold the flat-panel lamp in alignment within the fixture such that the electrical connections are connected to the externally accessible electrode contacts.

24 Claims, 8 Drawing Sheets

REMOVABLE FLAT-PANEL LAMP AND FIXTURE

CROSS REFERENCE TO RELATED APPLICATIONS

Reference is made to commonly-assigned pending U.S. patent application Ser. No. 11/158,151 filed Jun. 21, 2005, entitled "Removable Flat-Panel Lamp and Fixture" by Ronald S. Cok, the disclosure of which is incorporated herein.

FIELD OF THE INVENTION

This invention relates generally to area illumination and, more particularly, to power distribution and assembly in a flat-panel light fixture.

BACKGROUND OF THE INVENTION

Organic light emitting diodes are a promising solid-state lighting technology, combining area emission with a robust, flat structure well adapted to area illumination. Organic light emitting diodes (OLEDs) are manufactured by depositing organic semiconductor materials between electrodes on a substrate. Referring to FIG. 14, a prior-art OLED device 10 includes a substrate 100 on which are deposited a first electrode 110, one or more organic layers 120, for example including a hole-injection layer, a hole-transport layer, a light-emitting layer, an electron-transport layer, an electron-injection layer, and a second electrode 130. An encapsulating cover 140 protects and seals the OLED device 10. Light 200 is emitted from the device either through the cover 140 (as shown) or through the substrate 100 (not shown) depending on the composition and transparency of the substrate 100, cover 140, and electrodes 110 and 130. Electrode contacts are electrically connected to the electrodes 110 and 130 to connect the OLED to a power source. A great variety of OLED devices, structures, organic layers, and material compositions are described in the art. Such OLED devices enable the creation of light sources having extended surface area on a single substrate. The prior art describes the use of OLED devices in conventional lighting, for example U.S. Pat. No. 6,819,036 entitled "OLED Lighting Apparatus" by Cok, issued Nov. 16, 2004.

The lighting industry employs ceiling grids with luminaires, typically employing fluorescent lights, interspersed with fiber-composition panels in a suspended ceiling. For example, U.S. Publication 2002/0136001 A1 entitled "Low-profile Fluorescent Luminaire and Methods of Installation" describes a low-profile fluorescent luminaire for attachment to a suspended ceiling and methods for retrofitting the luminaire to an existing lighting system. The low-profile fluorescent luminaire has lightweight "I"-shaped framework comprising a pair of transversely-extending end plates attached adjacent to opposed longitudinal ends of a longitudinally-extending spine. The spine and the end plates have a substantially co-planar arrangement to provide a low-profile structure that closely conforms to the ceiling. The "I"-shaped framework supports a reflector positioned below the spine and end plates when the luminaire is in a supported functional position. The low-profile luminaire can be retrofitted to a suspended ceiling to replace the existing light fixtures or to supplement the light output of an existing lighting system without modifying or removing the existing lighting fixtures. U.S. patent application Ser. No. 10/978,190 filed Oct. 29, 2004 entitled Heat Conducting Mounting Fixture for Solid-State Lamp by Giana Maria Phelan et al. describes the use of OLED lamps in a suspended ceiling and employs a thermally conductive mounting member and is hereby incorporated in its entirety by reference.

The integration of a power distribution grid into a suspended ceiling fixture system is known in the prior art. For example, U.S. Pat. No. 3,504,172, granted Mar. 31, 1970, discloses a lighting fixture support and display device comprising an elongated channel having a top wall, vertically disposed side walls and a downwardly facing opening, said channel having an upper channel section and a lower channel section, an elongated plate disposed within said channel closing the upper channel section, means carried by said vertically disposed side walls engaging and supporting said plate, engagement of the last said means and said plate preventing outward displacement of said side walls, said plate having a plurality of openings spaced along its length and downwardly facing electric outlets carried in said openings, said upper channel retaining electric wiring for connecting said outlets to a source of electric energy, inwardly formed flanges carried by the lower edges of the side walls of said lower channel section, and a plurality of elongated closure elements removably carried in end to end relationship by said inwardly extending flanges to close said lower channel section, at least certain of said closure elements having openings for attachment of a pendant lighting fixture and switch means thereto, said fixture being provided with a plug for engaging one of said outlets to energize said fixture. However, there is no description providing power to flat-panel lamps in the fixture.

An important feature of suspended ceilings is the cost of removing or replacing faulty panels, particularly lamps mounted in the suspended ceilings. However, as described in the prior art, flat-panel lamps are not suitable for providing a simple and removable design for suspended ceilings. There is a need, therefore, for a flat-panel illumination system useful in suspended ceilings and providing a simple, safe, and reliable means of replacement and power distribution.

SUMMARY OF THE INVENTION

In accordance with one aspect of the present invention, there is provided a flat-panel lamp and fixture comprising:

a) a removable flat-panel lamp having at least two externally accessible electrode contacts;

b) a fixture for removably receiving the flat-panel lamp and providing electrical connections to the at least two externally accessible electrode contacts; and c) at least one rotating element that rotates to hold the flat-panel lamp in alignment within the fixture such that the electrical connections are connected to the externally accessible electrode contacts.

ADVANTAGES

The present invention provides a simple, safe, and reliable means of replacement and power distribution for a flat-panel lamp in a suspended ceiling.

These and other aspects, objects, features and advantages of the present invention will be more clearly understood and appreciated from a review of the following detailed description of the preferred embodiments and appended claims and by reference to the accompanying drawings.

BRIEF DESCRIPTION OF THE DRAWINGS

In the detailed description of the preferred embodiments of the invention presented below, reference is made to the accompanying drawings in which.

The figures are not drawn to scale, since the relative sizes of the various elements vary too greatly to permit a scaled depiction.

DETAILED DESCRIPTION OF THE INVENTION

Figure 1:
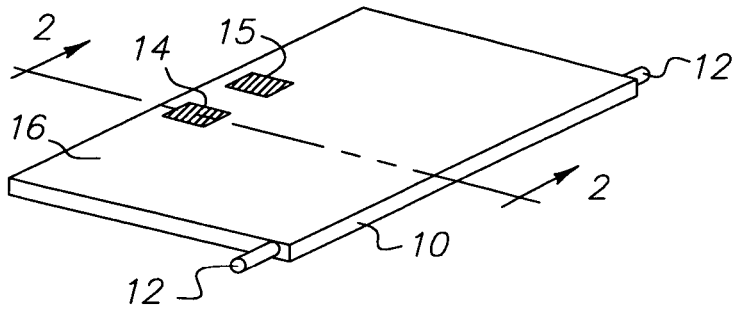
FIG. 1 is a perspective illustration of a flat-panel lighting system having rotating elements according to one embodiment of the present invention.
Figure 2:
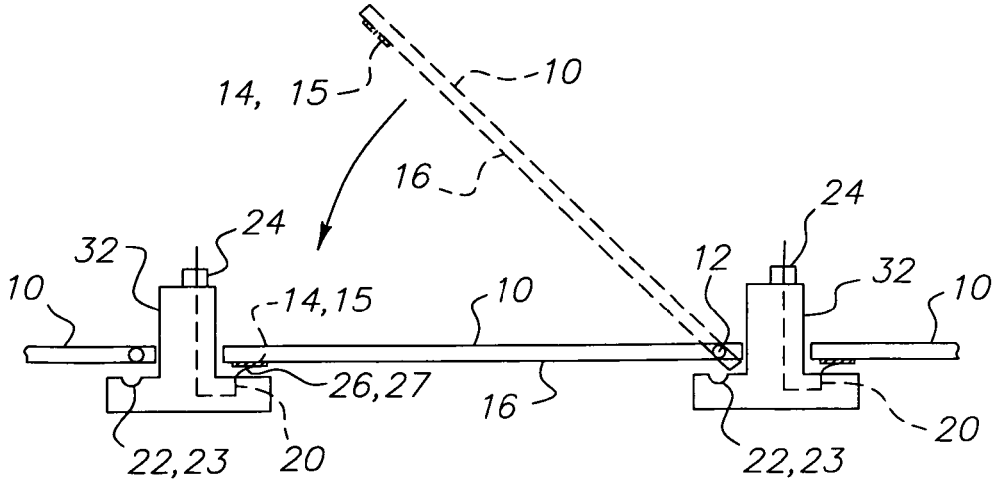
FIG. 2 is a partial cross-sectional view of a flat-panel lighting system according to an embodiment of the present invention as taken along line 2—2 of FIGS. 1 and 3.

Referring to FIGS. 1 and 2, a flat-panel lamp and suspended ceiling support system comprise a removable flat-panel lamp 10 having at least two externally accessible electrode contacts 14, 15 on a bottom surface 16 of the flat-panel lamp 10; a support member 32 for removably receiving the flat-panel lamp 10 and providing support contacts 26, 27 and electrical receptacle 24 to the at least two externally accessible electrode contacts 14, 15; and at least one rotating element 12 that allows the flat-panel lamp 10 to locate and rotate in alignment with the support member 32 such that the electrical connections 26, 27 are electrically connected to the electrode contacts 14, 15 respectively. Support contacts 26, 27 are electrically connected to a single electrical receptacle 24 by associated electrical wires 20 within support member 32. Alternatively, a plurality of receptacles 24 may be employed (not shown). The receptacle 24 is capable of being connected to an electrical power source (not shown).

Figure 3:
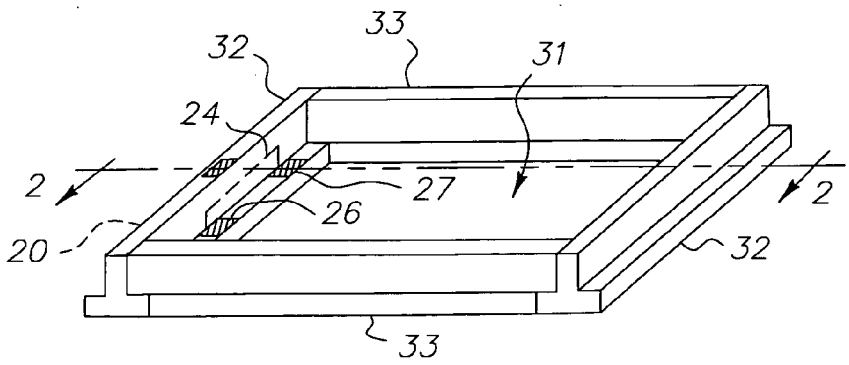
FIG. 3 is a perspective view of support members in one section of a flat-panel lighting system according to another embodiment of the present invention.
Figure 4:
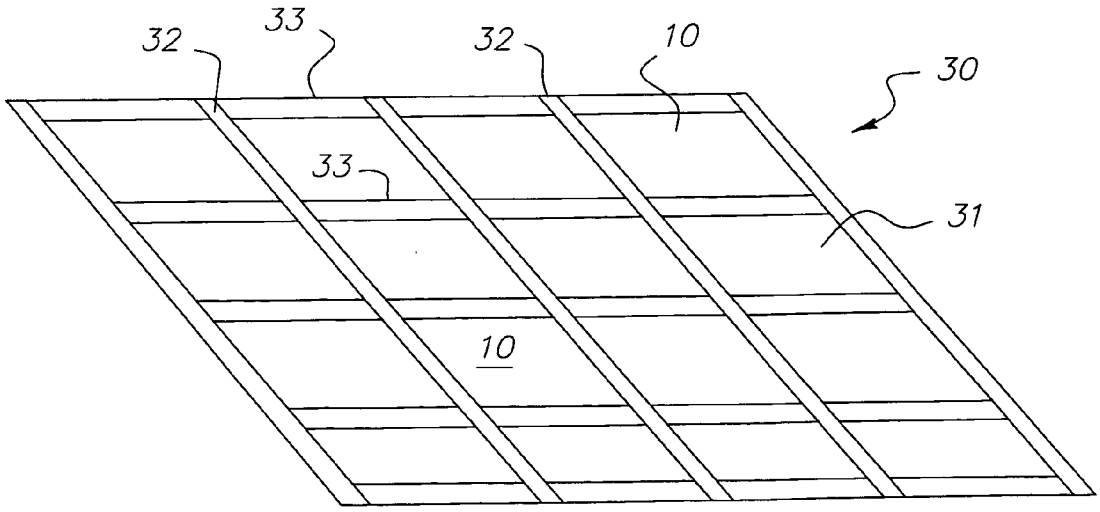
FIG. 4 is a perspective bottom view of a suspended ceiling support system for holding a plurality of flat-panel lamps according to an embodiment of the present invention.

Referring to FIGS. 3 and 4, the support members 32, 33 may be a suspended ceiling system 30 comprising a grid of support members 32 and 33 between which one or more flat-panel lamps 10 may be positioned. The cross-sectional shape of the support member 32 and 33 will depend upon the type of electrical connection and support scheme as described below. In particular FIG. 3 illustrates a suspended ceiling system 30 having a single opening 31 wherein a single flat-panel 10 may be placed and FIG. 4 illustrates a suspended ceiling system 30 having a plurality of openings that holds one or more lamps 10 depending on the requirements of the room. Fiber-composition tile sections may be placed in the openings 31 where flat-panel lamps are not placed.

Figure 10:
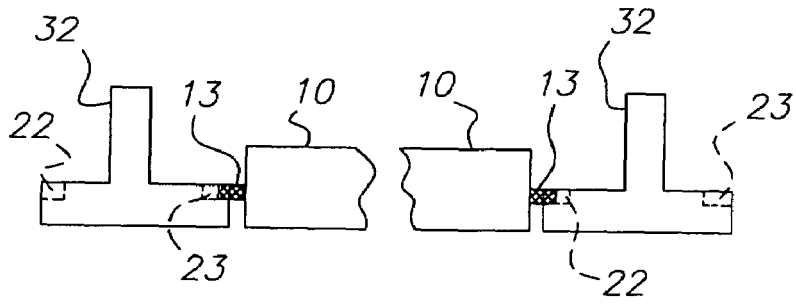
FIG. 10 is a partial cross-sectional view of a flat-panel lamp aligned with corresponding contacts in a suspended ceiling support system according to an embodiment of the present invention.

A variety of means may be employed to provide the rotating element 12 according to various embodiments of the present invention. As shown in FIGS. 1, 2 and 10, the rotating elements 12 are pins that protrude from either side of the flat-panel lamp 10 and rest in complementary shaped recesses 22, 23 in the edge of support member 32. The electrode contacts 14, 15 may be flat and coated on a substrate or cover of the flat-panel lamp 10. Support contacts 26, 27, connected to the electrical receptacle 24 by wires 20, may deform under the pressure of the flat-panel lamp 10 to provide an electrical contact with positive pressure to the electrode contacts 14, 15 when the electrode contacts 14, 15 are brought into contact with the support contacts 26, 27. For example, when the flat-panel lamp 10 is in position within the support member 32, the electrode contacts 14, 15 can rest on deformable strips of metal 26, 27 on the support member 32 that is connected to the electrical receptacle 24 and thence to an electrical supply, for example a household or commercial building power supply, such as 120 or 240 volts AC.

Figure 12:
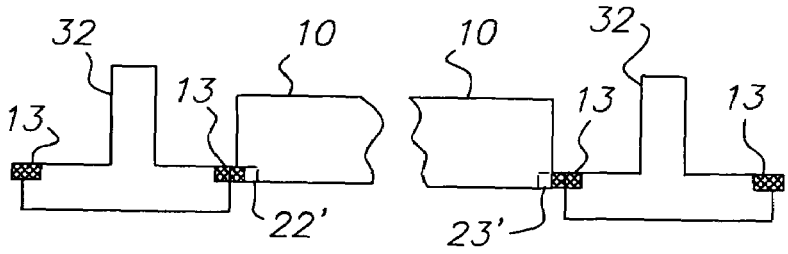
FIG. 12 is a partial cross-sectional view of a flat-panel lamp having a recess to receive a rotating element integrated into a suspended ceiling support system according to an embodiment of the present invention.

Alternatively, as shown in FIG. 12, support contacts (e.g. pins) 13 may protrude from a support member 32 and be received in recesses 22', 23' formed in the flat-panel lamp 10. The other edges of the flat-panel lamp 10 may be supported with latches as described below.

Alternatively, the flat-panel lamp 10 and fixture 30 may employ protruding electrode contacts 18, 19 that protrude from the surface of the flat-panel lamp 10 and support contacts 26, 27 located within a socket 28 or sockets 28, 29 within the support member 32 to receive the protruding electrode contacts 18, 19 and connect them to the electrical connections 24, 25.

Figure 7A:
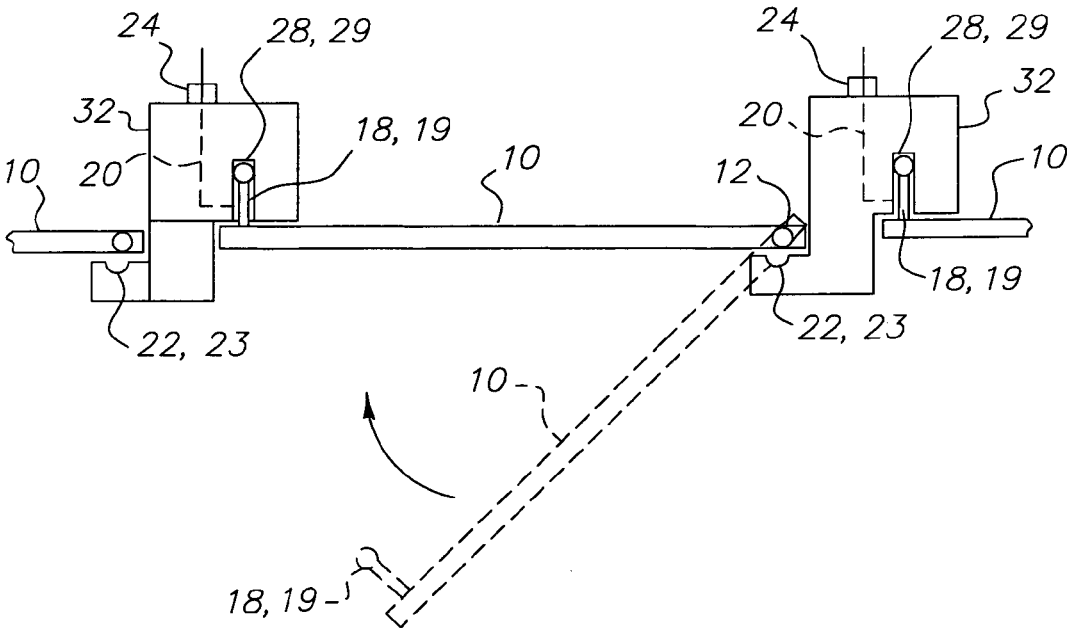
FIG. 7*a* is a partial cross-sectional view of a flat-panel lamp and suspended ceiling support system according to yet another alternative embodiment of the present invention.
Figure 7B:
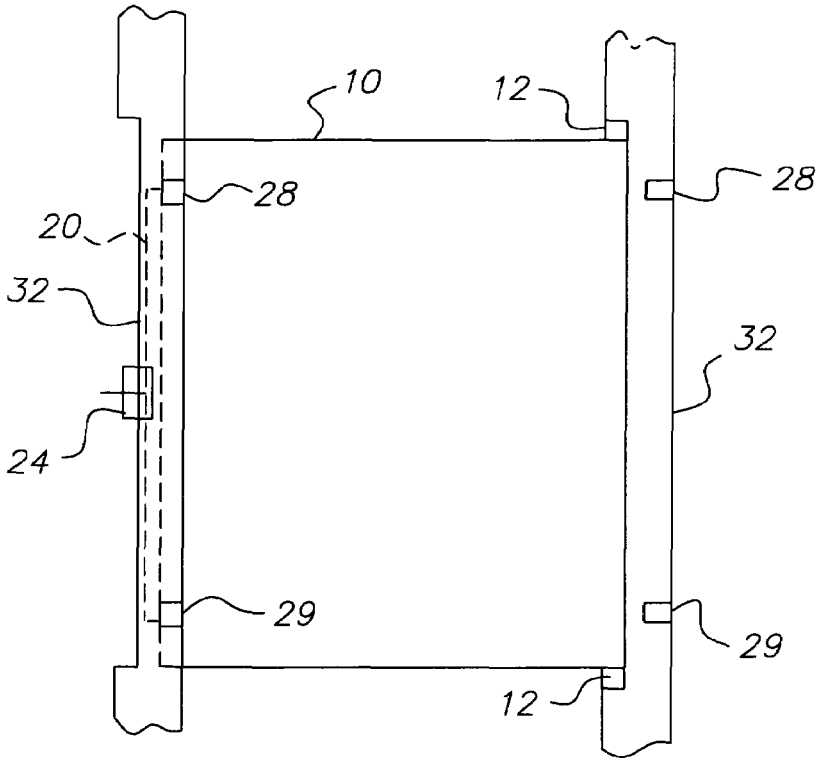
FIG. 7*b* is a top view of a flat-panel lamp and portion of a suspended ceiling support system corresponding to FIG. 7*a;*
Figure 7C:
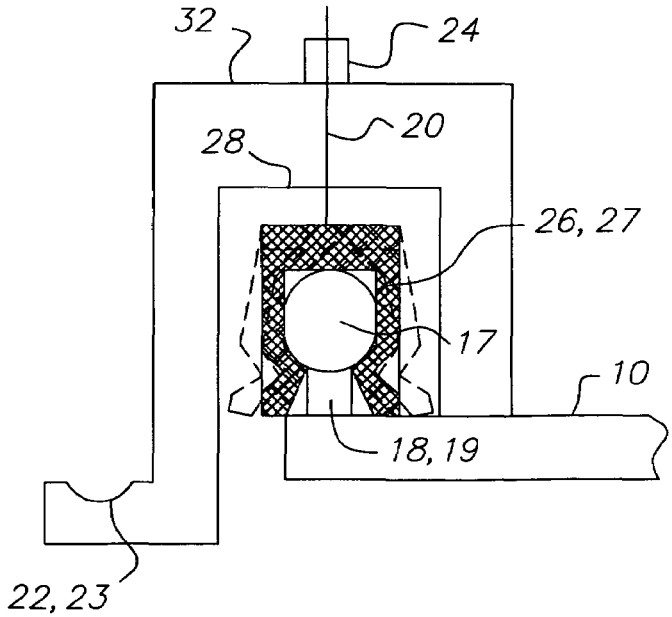
FIG. 7*c* is a partial cross-sectional detail view corresponding to FIG. 7*a;*

Referring to the cross-sectional views of FIG. 7*a* and FIG. 7*c* and the top view of FIG. 7*b*, the protruding electrode contacts 18, 19 extend vertically from the surface of the flat-panel lamp 10. When the flat-panel lamp 10 is in operable position in support member 32, the electrode contacts 18, 19 are removably received in corresponding sockets 28, 29 formed in support member 32 that includes the electrical connections 20 and support connections 26, 27. The protruding electrode contacts 18, 19 may include a protruding element 17, as shown, that can be caught and held by a corresponding deformable connection 26, 27 in the support member 32 to locate the flat-panel lamp 10 in position. Deformable connections 26, 27 are shown in the deformable position by dash lines. As shown in FIG. 7*c*, both electrode contacts 18 and 19 may be inserted into a single socket 28 or, alternatively, separate sockets 28 and 29 may be employed for each electrode contact. Moreover, the design of the corresponding sockets, the latching mechanism, and the shape of the electrode contacts 18 may vary.

Figure 9A:
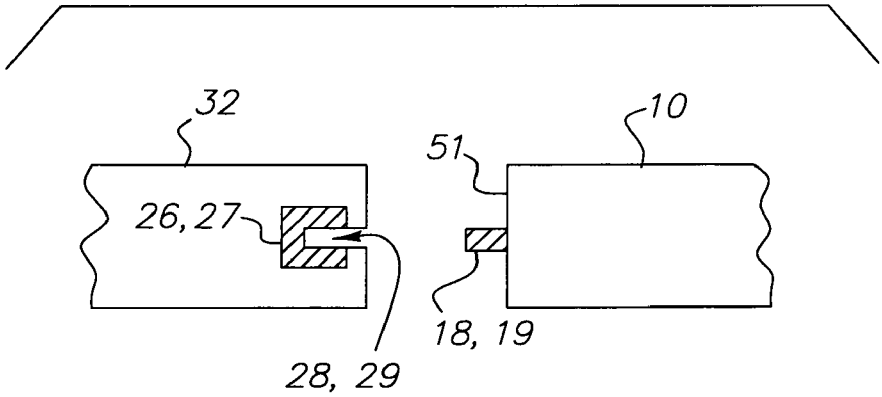
FIGS. 9*a* and 9*b* are partial cross-sectional views of alternative electrode contact configurations in a flat-panel lamp according to various embodiments of the present invention.

A wide variety of methods and structures known in the prior art may be employed to locate and hold a flat-panel lamp 10 within a support member 32 while providing suitable electrical connections. For example, referring to FIG. 9*a* in an alternative embodiment of the present invention, the electrode contacts 18, 19 may protrude horizontally from an edge 51 of the flat-panel lamp 10 and sockets 28, 29 formed in a corresponding support member 32 may have a corresponding horizontal configuration.

Figure 9B:
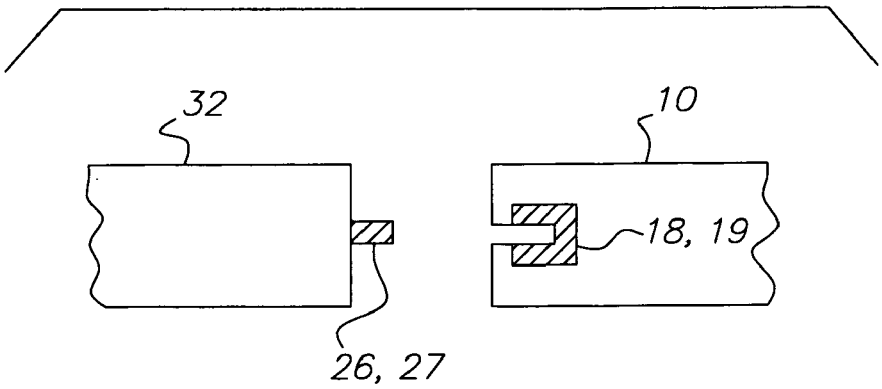

Referring to FIG. 9*b*, in yet another embodiment, the flat-panel lamp 10 may have an opening in which the electrode contacts 18, 19 are located and the corresponding support member 32 may have protruding support contacts 26, 27 that are inserted into the opening when the flat-panel lamp 10 is in position.

In the embodiment of FIGS. 1–4, the flat-panel lamp 10 is positioned in the suspended ceiling system 30 by lifting the entire flat-panel lamp at an angle through the supporting members 32 of the suspended ceiling system 30 (as is conventionally done to replace ceiling tiles in a conventional suspended ceiling, for example). The rotating elements 12 (for example pins) are then located in the complementary recesses 22, 23 in the support members 32 (as shown with the dashed lines in FIG. 2) and the flat-panel lamp 10 (shown with dashed lines) is rotated about the rotating elements 12 near the edge of the lamp 10 (as shown by the arrow) and lowered down until it rests in the recesses 22, 23 in support member 32 with the electrode contacts 14, 15 in electrical contact with the support contacts 26, 27 and the electrical connections 20. In FIG. 7, the rotating elements 12 of the flat-panel lamp 10 are located in the recesses 22, 23 by lifting only the flat-panel lamp edge having the rotating elements 12 through the opening between the support members 32 and then rotating the flat-panel lamp 10 upwards about the rotating elements 12 (as shown by the arrow) until the protruding electrode contacts 18, 19 are caught and held in the socket 28, 29 of support member 32 with the protruding electrode contacts 18, 19 in contact with the support contacts 26, 27.

While the embodiments shown in FIGS. 1, 2, 7, and 10 employ pins to form the rotating elements, a wide variety of rotary hinges may be utilized as are known in the mechanical arts. For example, a piano hinge may be used. Moreover, the rotating elements 12 may be located at a variety of positions in the flat-panel lamp 10, for example near one edge (as illustrated), or in the center, or at opposite edges.

Figure 11:
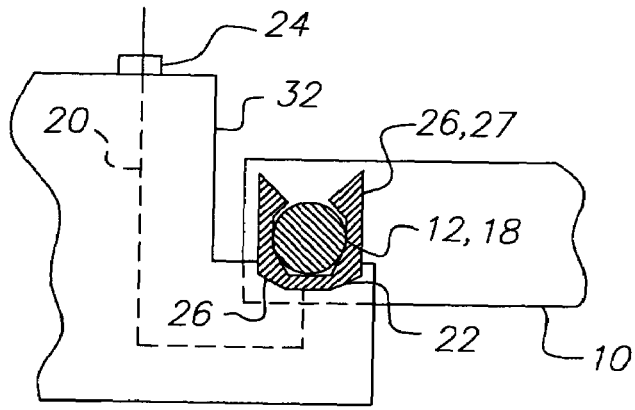
FIG. 11 is a partial cross-sectional view of a flat-panel lamp having an integrated rotating element and electrode contact according to an embodiment of the present invention.

It is also possible to incorporate the electrode contacts 14, 15 in the rotating elements 12. For example, referring to FIG. 11, rotating element 12 shown in FIG. 1 may be metal and form a protruding electrode contact 18 while the recess 22 in the support member 32 may likewise include a metal electrically conducting surface that is part of the electrical deformable contact 26. A wide variety of embodiments may be employed to facilitate an electrical connection through the rotating elements 12. Both electrode contacts may pass through a single rotating element 12 or separate rotating elements 12 may be employed for each electrode contact. Rotating hinges may be used and the hinges connected to electrical connections in the rotating hinges and to the electrode contacts.

Figure 5A:
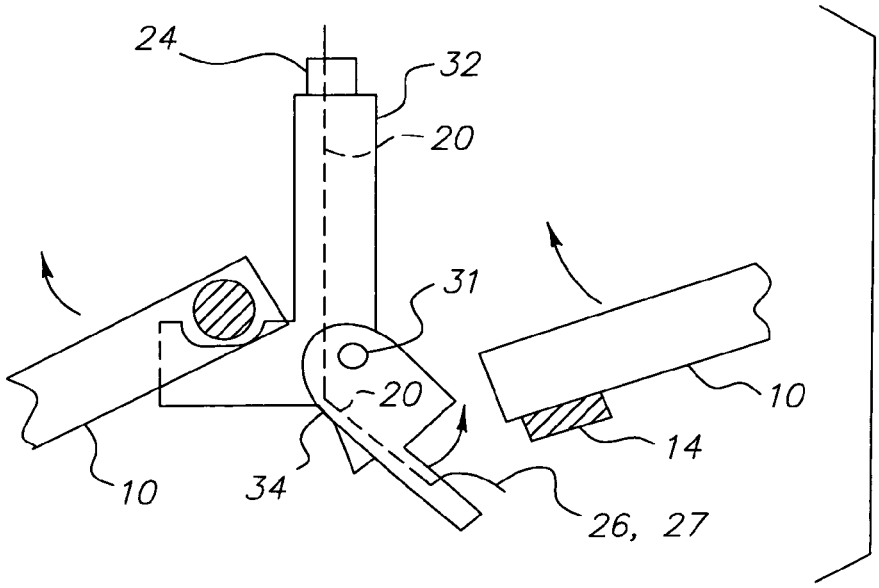
FIGS. 5*a* and 5*b* are partial cross-sectional views of portions of two flat-panel lamps in a suspended ceiling support system with lamp-retaining latches according to different embodiments of the present invention.
Figure 5B:
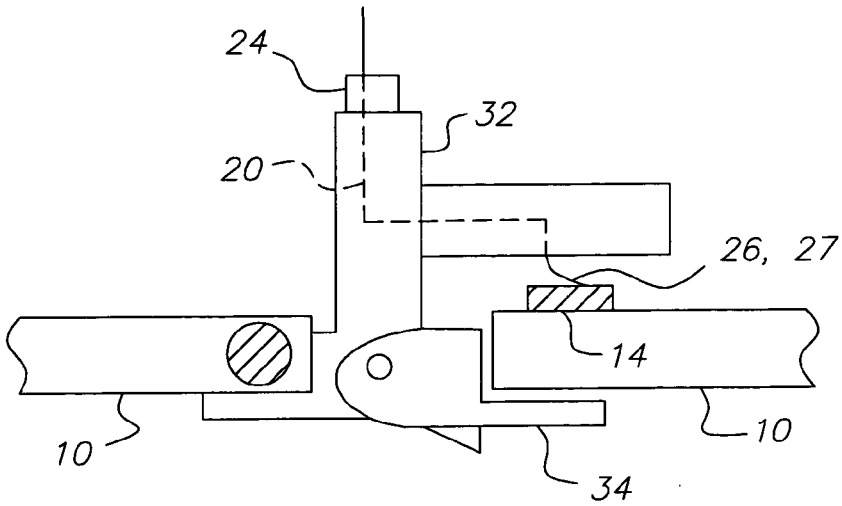

Referring to FIGS. 5*a* and 5*b*, support member 32 may include latches 34 attached to the support members 32 that rotate into position to hold the flat-panel lamp 10 in the operative position, for example by employing spring-loaded pins 31 that are provided in detent in the support member 32. The latches may be purely mechanical (as shown in FIG. 5*b*) or may incorporate support contacts 26, 27 (as shown in FIG. 5*a*).

Figure 6:
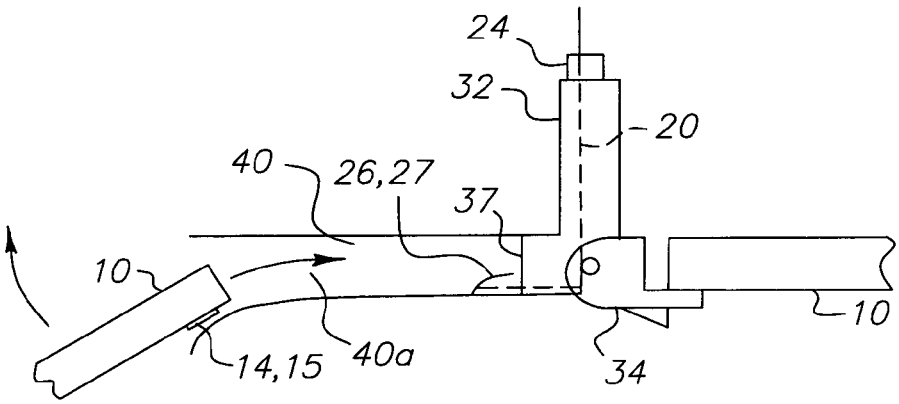
FIG. 6 is a partial cross-sectional view of a flat-panel lamp and suspended ceiling support system according to an alternative embodiment of the present invention.

As shown in the embodiment of FIG. 6, the rotating element is the flat-panel lamp 10 itself. In FIG. 6, a channel 40 is employed in the support member 32 to removably accept the flat-panel lamp 10. In order to removably insert the flat-panel lamp 10 into the support member 32, the flat-panel lamp 10 is rotated as one edge of the flat-panel lamp 10 is inserted into the channel 40 until it contacts a mechanical stop 37. Support contacts 26, 27 similar to those of the other embodiments may be employed to electrically connect the electrode contacts 14, 15 to the electrical connections 20. A rotatable latch 34 in the embodiment illustrated is provided at the end opposite the inserted end of the flat-panel lamp to hold the flat-panel lamp 10 in place in the support member 32. The channels 40 in the support member 32 must have at least one portion 40*a* of the channel 40 having a depth deeper than the thickness of the portion of the flat-panel lamp 10 inserted into the channel wherein the rotating element 12 is the flat-panel lamp 10.

Figure 13:
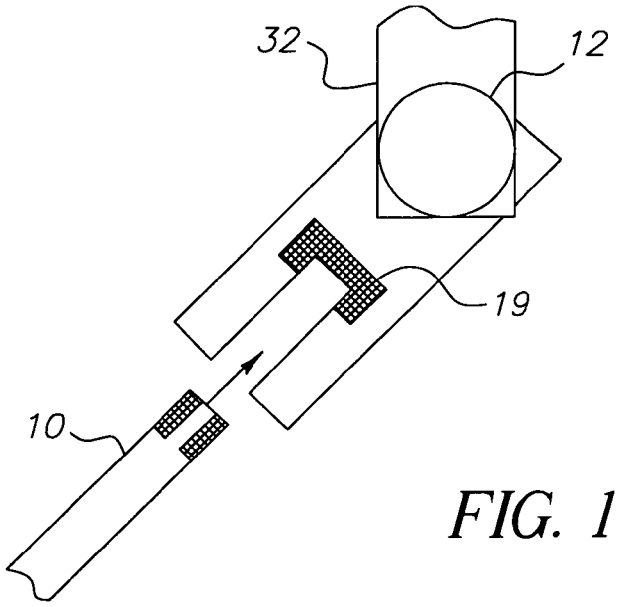
FIG. 13 is a partial cross-sectional view of a flat-panel lamp having a recess to receive a rotating element integrated into a suspended ceiling support system according to another embodiment of the present invention.
Figure 14:
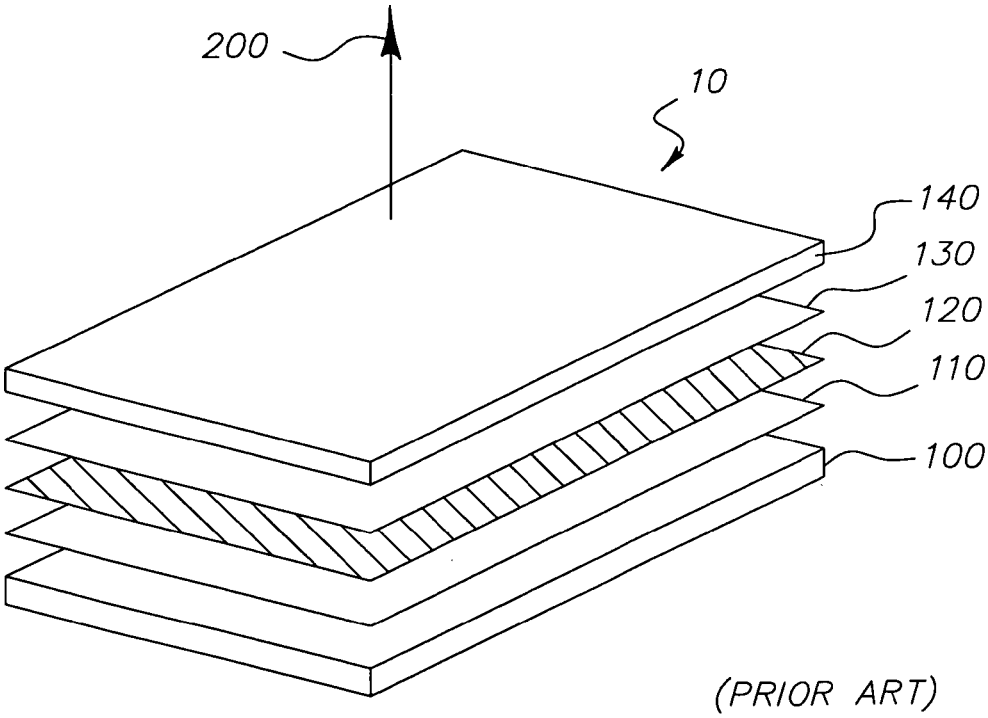
(PRIOR ART) FIG. 14
FIG. 14 is an exploded perspective illustration of a prior-art flat-panel lamp.

FIG. 13 illustrates the embodiment of FIG. 6 with a rotating element 12 for receiving the flat-panel lamp 10 so as to provide readier access.

Figure 8:
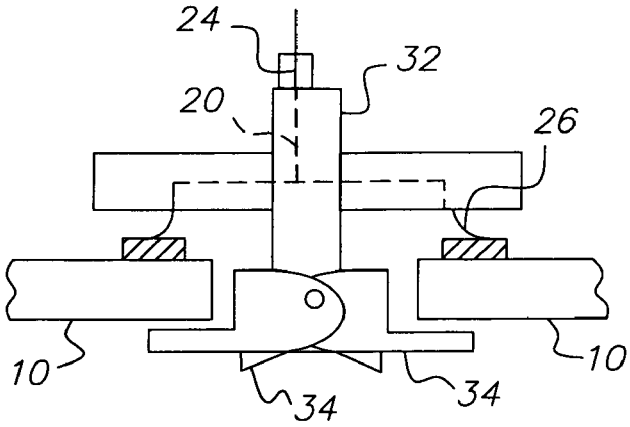
FIG. 8 is a partial cross-sectional view of a portion of a flat-panel lamp and suspended ceiling support system according to an alternative embodiment of the present invention.

The support member 32 may include a latch 34 attached to the support member 32 that, when rotated, holds the flat-panel lamp 10 in alignment with the support member 32. The flat-panel lamp 10 may be brought into alignment with the support members 32 by lifting it into the suspended ceiling 30, while keeping it largely horizontal, and then securing the rotating latches 34. Referring to FIG. 8, the support members 32 include rotating latches 34 that secure the flat-panel lamps 10 in alignment with the support members 32 without the need to rotate the flat-panel lamp 10.

The flat-panel lamp 10 substrate may be rigid, for example comprising glass. Alternatively the lamp 10 may be flexible and comprise a flexible plastic substrate and/or cover. If the OLED lamp is flexible, it may be inserted into position in alignment with the fixture by rotating portions of the substrate, that is, by bending or folding the substrate. This may be useful, for example in embodiments such as those shown in FIG. 6, by reducing or eliminating the need for the channel 40 to have a deeper portion 40*a*. A flexible OLED lamp or complementary fixture may also have a rigid perimeter support for supporting or holding the flexible lamp.

The present invention may also be practiced with either active- or passive-matrix OLED devices. In a preferred embodiment, the present invention is employed in a flat-panel OLED device composed of small molecule or polymeric OLEDs as disclosed in but not limited to U.S. Pat. No. 4,769,292, issued Sep. 6, 1988 to Tang et al., and U.S. Pat. No. 5,061,569, issued Oct. 29, 1991 to VanSlyke et al. Many combinations and variations of organic light-emitting displays can be used to fabricate such a device, including both active- and passive-matrix OLED displays having either a top- or bottom-emitter architecture.

The invention has been described in detail with particular reference to certain preferred embodiments thereof, but it will be understood that variations and modifications can be effected within the spirit and scope of the invention.

PARTS LIST

10 flat-panel lamp
12 rotating element
13 pins
14 electrode contact
15 electrode contact
16 bottom surface
17 protruding element
18 protruding electrode contact
19 protruding electrode contact
20 electrical connections
21 latch
22, 22' recess
23, 23' recess
24 electrical receptacle
25 electrical receptacle
26 support contacts
27 support contacts
28 socket
29 socket
30 suspended ceiling system
31 opening
32 support member
33 support member
34 latch
37 mechanical stop
40 channel
40*a* deep portion of channel
51 edge
100 substrate
110 electrode
120 organic layers
130 electrode
140 cover
200 light

The invention claimed is:

1. A flat-panel lamp and fixture comprising:

a removable flat-panel lamp having at least two externally accessible electrode contacts;

a fixture for removably receiving the flat-panel lamp and providing electrical connections to the at least two externally accessible electrode contacts; and at least one rotating element for rotating the flat-panel lamp relative to the fixture and holding the flat-panel lamp in alignment within the fixture such that the electrical connections are connected to the externally accessible electrode contacts.

2. The flat-panel lamp and fixture according to claim 1 wherein the flat-panel lamp is an OLED lamp.

3. The flat-panel lamp and fixture according to claim 1 wherein the electrode contacts are flat and wherein the electrical connections deform to provide an electrical contact to the electrode contacts when the electrode contacts are brought into contact with the electrical connections.

4. The flat-panel lamp and fixture according to claim 3 wherein the electrical contact is a strip of metal.

5. The flat-panel lamp and fixture according to claim 1 wherein the electrode contacts protrude from the surface of the flat-panel lamp and wherein the electrical connections are located within a socket to receive the protruding electrode contacts.

6. The flat-panel lamp and fixture according to claim 1 wherein the electrical connections protrude from the fixture and the electrode contacts are located within a socket in the flat-panel lamp to receiving the protruding electrical connections.

7. The flat-panel lamp and fixture according to claim 1 wherein the one or more rotating elements are one or more rotating hinges that rotate the flat-panel lamp.

8. The flat-panel lamp and fixture according to claim 1 wherein the electrode contacts are connected to rotating elements and the electrical connections are made to the rotating elements.

9. The flat-panel lamp and fixture according to claim 1 wherein at least two electrode contacts are connected within one rotating element.

10. The flat-panel lamp and fixture according to claim 1 comprising at least two rotating elements and wherein at least one electrode contact is connected through each rotating element.

11. The flat-panel lamp and fixture according to claim 1 wherein the rotating element also comprises one or more electrode contacts.

12. The flat-panel lamp and fixture according to claim 1 wherein the one or more rotating elements are pins protruding from the flat-panel lamp and further comprising a detent formed in the fixture to receive the pins.

13. The flat-panel lamp and fixture according to claim 12 wherein the pin is an electrode contact.

14. The flat-panel lamp and fixture according to claim 1 comprising a detent formed in the flat-panel lamp and wherein the at least one rotating element protrudes from the fixture.

15. The flat-panel lamp and fixture according to claim 1 wherein the at least one rotating element is positioned to rotate the flat-panel lamp about one edge of the flat-panel lamp.

16. The flat-panel lamp according to claim 1 is rotated into alignment with respect to the fixture.

17. The flat-panel lamp and fixture according to claim 1 further comprising channels in the fixture having a channel opening with at least one portion of the channels having a depth deeper than the thickness of the flat-panel lamp wherein the flat-panel lamp is rotated into alignment with respect to the fixture.

18. The flat-panel lamp and fixture according to claim 16 wherein the flat-panel lamp is removably inserted by inserting the edge of the flat-panel lamp into the channel by simultaneously rotating the flat-panel lamp and sliding the flat-panel lamp in the channel.

19. The flat-panel lamp and fixture according to claim 1 wherein the rotating element is a latch attached to the fixture that, when rotated, holds the flat-panel lamp in alignment with the fixture.

20. The flat-panel lamp and fixture according to claim 19 wherein the flat-panel lamp is brought into alignment with the fixture by lifting it into the fixture and then securing the rotating latches.

21. The flat-panel lamp according to claim 1 wherein the flat-panel lamp is a rigid lamp.

22. The flat-panel lamp according to claim 1 wherein the flat-panel lamp is a flexible lamp.

23. The flat-panel lamp according to claim 1 wherein the flat-panel lamp and fixture are part of a suspended ceiling.

24. The flat-panel lamp according to claim 1 further comprising a latch to hold the flat-panel lamp in position within the fixture.

* * * * *